US006752254B1

(12) United States Patent
Allen et al.

(10) Patent No.: US 6,752,254 B1
(45) Date of Patent: Jun. 22, 2004

(54) REDUNDANT COIN PROCESSING SYSTEM FOR AUTOMATIC COIN MACHINES

(75) Inventors: Jim Allen, 779 Peac Church Rd., Wetumpka, AL (US) 36093; Dana Alan Dick, Wetumpka, AL (US); David C. Allen, Sr., Wetumpka, AL (US); Malcolm C. Talley, Wetumpka, AL (US)

(73) Assignee: Jim Allen, Wetumpka, AL (US)

( * ) Notice: Subject to any disclaimer, the term of this patent is extended or adjusted under 35 U.S.C. 154(b) by 223 days.

(21) Appl. No.: 10/157,907

(22) Filed: May 31, 2002

Related U.S. Application Data

(60) Provisional application No. 60/294,218, filed on May 31, 2001.

(51) Int. Cl.[7] ..... G07F 1/00
(52) U.S. Cl. ..... 194/346
(58) Field of Search ..... 194/346, 200, 194/344, 345, 350, 356; 700/2, 219, 223

(56) References Cited

U.S. PATENT DOCUMENTS

| | | | | |
|---|---|---|---|---|
| 2,646,215 A | | 7/1953 | Stovall | |
| 2,769,165 A | | 10/1956 | Bower | |
| 2,908,895 A | | 10/1959 | Cooper | |
| 3,018,469 A | | 1/1962 | Grant et al. | |
| 3,070,293 A | | 12/1962 | Rosapepe | |
| 3,090,941 A | | 5/1963 | Breese | |
| 4,256,128 A | * | 3/1981 | Chiappetti | 194/215 |
| 4,503,961 A | | 3/1985 | Chittleborough | |
| 4,635,661 A | * | 1/1987 | Uematsu et al. | 194/217 |
| 4,838,406 A | | 6/1989 | Levasseur | |
| 5,040,658 A | | 8/1991 | Levasseur | |
| 5,829,569 A | | 11/1998 | Cheng et al. | |
| 6,171,182 B1 | | 1/2001 | Geib et al. | |
| 6,264,545 B1 | | 7/2001 | Magee et al. | |
| 6,318,537 B1 | * | 11/2001 | Jones et al. | 194/346 |

FOREIGN PATENT DOCUMENTS

DE 38 34 122 A1 * 4/1990 ..... G07F/5/08

* cited by examiner

*Primary Examiner*—Donald P. Walsh
*Assistant Examiner*—Mark Beauchaine
(74) *Attorney, Agent, or Firm*—Shaw Pittman LLP

(57) ABSTRACT

An automatic coin machine having a redundant coin processing system with at least two coin processing mechanisms. The first or the active coin processing mechanism is initially set up to receive coins from a coin diverter which is in communication with a coin collection device. While the active coin processing mechanism is processing the coins received from the coin diverter, the inactive or the second coin processing mechanism can be serviced without affecting operation of the active coin processing mechanism. When the first coin processing mechanism becomes disabled, in need of service, or is otherwise idle, the coin diverter is switched from the first coin processing mechanism to the second coin processing mechanism, thus making the first coin processing mechanism inactive, and at the same time, making the second processing mechanism active. Similarly, the coin diverter can be switched back over to the first coin processing mechanism when the second coin processing mechanism becomes disabled, in need of service, or is otherwise idle.

42 Claims, 9 Drawing Sheets

REDUNDANT COIN PROCESSING SYSTEM FOR AUTOMATIC COIN MACHINES

This application claims the benefit of U.S. Provisional Application No. 60/294,218, filed May 31, 2001, which is incorporated herein by reference in its entirety.

BACKGROUND

1. Field of the Invention

The present invention relates generally to an automatic coin machine (ACM). More particularly, the present invention can be adapted to be used as an ACM having a coin diverter and two or more coin processing mechanisms for toll road applications.

2. Background of the Invention

The construction, maintenance, and operation of transportation infrastructures such as roads, tunnels, bridges, and the like can be every expensive. As a result, many infrastructures have toll collection systems that receive fares or tolls from users of the infrastructures. The toll revenue serves to defray the cost incurred in constructing the infrastructures. The toll revenue can also be used to maintain the infrastructures. In addition, the toll revenue can provide income to governmental or commercial entities that operate the infrastructures.

In early toll collection systems, attendants were employed to manually collect tolls from operators of vehicles and to regulate the tolls. Utilizing attendants to collect fares involves numerous problems, including the elements of human error, inefficiencies, and traffic delays. Among other things, manual collection of tolls can be inefficient (time consumed when attendant manually collects fares from drivers) and expensive (costs incurred in hiring the attendants to operate the systems at all hours of the day and night). Furthermore, toll operators may incur further losses through embezzlement of cash by toll booth attendants.

To overcome the disadvantages associated with manual toll collection, devices have been developed to automatically operate toll collection systems without the need for toll attendants. For example, U.S. Pat. No. 2,646,215 issued to Stovall on Jul. 21, 1953, discloses an "Automatic Toll Collector Device"; U.S. Pat. No. 2,769,165 issued to Bower on Oct. 30, 1956, discloses an "Automatic Toll Collection System"; U.S. Pat. No. 2,908,895 issued to Cooper on Oct. 13, 1959, discloses an "Automatic Toll Collection System"; and U.S. Pat. No. 3,090,941, issued to Breese on May 21, 1963, discloses a "Toll Collecting Device."

A typical automatic toll collection system involves the use of a toll station or toll booth positioned at each lane of traffic so that vehicles driving on the highway must pass through the toll lane next to the toll booth. The passage of vehicles through each toll lane can be monitored with loop detectors, treadles, radar, light curtains or other devices capable of detecting passing vehicles. An ACM is installed at the toll booth of each toll lane and connected electronically to a toll gate and/or a traffic signal system. Operators of the vehicles are required to place the required fare into the collection basket of the ACM when passing by the toll station. The ACM registers the fare and operates the toll gate and/or the traffic signal system associated with the toll lane.

An ACM that is used in such a toll collection system is typically equipped with a coin receiving means and a coin processing mechanism. The coin receiving means is used to accept coins from vehicle operators. The coin receiving means is typically an open, funnel-shaped basket or coin hopper into which coins are tossed by motorists. The coin receiving means channels the collected coins into an inlet opening of the coin processing mechanism, which is typically placed below the coin receiving means. The coin processing mechanism (also known as a metering device or a meter box) is connected to a circuit for operating the toll gate and/or the traffic signal system. The term "coin" signifies the method of payment regardless of denomination or origin. Coins types include local currency, foreign currency, and tokens.

The process involved in the ACM is quite simple. When coins are collected by the coin receiving means, they are funneled into the coin processing mechanism, which then registers the fare and activates the toll gate and/or the traffic signal system. For example, ACMs are disclosed in U.S. Pat. No. 2,646,215 (Automatic Toll Collector Device) issued to Stovall on Jul. 21, 1953; U.S. Pat. No. 3,018,469 (Fare Collection and Signal System for Toll Roads) issued to Grant on Jan. 23, 1962; and U.S. Pat. No. 3,070,293 (Toll Collection Boxes) issued to Rosapepe on Dec. 25, 1962.

Typically, the ACM is securely located within the toll booth near the ground surface. The toll booth is often designed so that a portion of the toll booth wall extends outwardly toward the toll lane. This extension of the toll booth wall is referred to as a blister, and the ACM is often placed within this blister. The receiving means (typically a coin basket or a coin hopper) of the ACM is also attached to the outside of the toll booth, such that it is easily accessible to passing motorists. An opening in the blister allows the receiving means to be connected to the inlet of the coin processing means, which is located within the toll booth.

Unfortunately, typical automated toll collection systems are not completely reliable to provide uninterrupted collection of fares from motorists. The unreliability is particularly obvious in toll lanes that are not equipped with an alternative method of toll collection. The flow of traffic through an ACM-equipped toll lane can be severely disrupted when the ACM fails to function. For example, the ACM may stop working when the coin vault is full. Furthermore, the ACM may become inoperative if coins are stuck within the coin processing mechanism. In addition, vandals can pass through toll lanes and throw all types of foreign materials into the coin receiving means in attempts to damage or jam the coin processing mechanism. Thus, many things can happen to cause the ACM to be taken out of service.

Whenever the ACM is removed from service for any reason, the revenue collection capability in that toll lane is stopped or limited to another method of coin collection. If the affected toll lane is equipped with the ACM as the sole method of collecting revenues, no toll can be collected from motorists, resulting in a significant loss of revenue. If a manual collection system is used while the ACM is being repaired, the traffic flow can be significantly affected causing great inconvenience to the motoring public.

Accordingly, there is a need for a system that can continuously collect tolls from motorists without the above-described unreliability of existing toll collection systems. There is a need for an improved ACM that can provide increased operational availability given the increase in use and abuse by the motoring public.

SUMMARY OF THE INVENTION

The present invention provides an ACM with a redundant coin processing system having two or more coin processing mechanisms. An embodiment of the invention includes a coin collection device, two coin processing mechanisms, and a coin diverter that channels coins received from the coin collection device to one of the two coin processing mechanisms. Preferably, the coin diverter is an electronic coin diverter. Preferably, the coin diverter can be electronically switched from one coin processing mechanism to another coin processing mechanism based on predefined circumstances or service conditions associated with the coin processing mechanisms. The coin diverter can also be manually switched from a first coin processing mechanism to a second coin processing mechanism, and vice versa. It is noted that the present invention can be adapted to process not only coins, but also tokens or other suitable forms of payments.

The first coin processing mechanism is initially set up to receive coins from the coin collection device through the coin diverter. While the first coin processing mechanism is active, i.e., processing coins received from the coin diverter, the second coin processing mechanism (the inactive coin processing mechanism) can be serviced. When the first coin processing mechanism becomes disabled, in need of service, or is otherwise idle, the coin diverter is switched away from the first coin processing mechanism over to the second coin processing mechanism, thus making the first coin processing mechanism inactive, and at the same time, making the second processing mechanism active. Similarly, the coin diverter can be switched over back to the first coin processing mechanism when the second coin processing mechanism needs to be serviced.

One specific embodiment of the present invention is a toll lane ACM having a coin collection basket, two coin processing mechanisms, and an electronic coin diverter that is controlled by an automatic coin mechanism system unit. The ACM system unit has a microprocessor that can execute instruction sets associated with the present invention. As coins are received via the coin collection basket, the electronic coin diverter directs or channels the coins toward a first coin processing mechanism to be deposited in a vault associated with the first coin processing mechanism. The second coin processing mechanism and its associated coin vault remain available for switchover.

The switchover from the first coin processing mechanism to the second coin processing mechanism can occur under one of several circumstances or service conditions. For example, the service conditions can include one or more of equipment failure, preventative maintenance, vault change, and other planned workload distribution.

The electronic coin diverter is preferably installed below the coin collection basket. The discharge position of the coin diverter (which determines which coin processing mechanism is to receive the coins), the activation status of the coin processing mechanism, and the selection of a coin vault can be automatically controlled by the lane controller computer and lane application software, or can be manually overridden by the either remote or local switch commands by authorized operations or maintenance personnel.

In one embodiment, the coin diverter can also be manually switched by a toll booth attendant whenever the toll booth attendant wants to activate or deactivate a particular coin processing mechanism.

In another embodiment in which the capacity of a coin vault or vaults associated with the ACM is electronically monitored, the coin diverter can be automatically switched to a different coin processing mechanism whose vault or vaults are empty or have excess capacity to receive more coins.

In still another embodiment, the coin diverter can be electronically switched from diverting coins to a jammed coin processing mechanism to diverting coins to a standby coin processing mechanism upon detection of the jammed condition.

In still another embodiment, the ACM of the present invention can be adapted to notify a maintenance department or a service entity associated with the toll lane that service is required on a coin processing mechanism.

Accordingly, one aspect of the present invention provides for uninterrupted processing of transactions during periods when one of the coin processing mechanisms is being serviced. Thus, the redundant coin mechanisms allows for a higher percentage of toll lane uptime. Another aspect of the present invention provides means for distributed processing of transactions when both coin mechanisms are available. The invention therefore extends the operational life of an ACM by distributing coin processing tasks among multiple coin processing mechanisms.

In summary, the redundant coin processing system of the invention ensures that the toll lane has a longer, if not continuous, uptime. In addition, the redundant coin processing system helps extend the useful life the ACM. Although the preferred use of the invention is for toll collection applications, it must be noted that the present invention can be adapted for other applications in which coin processing is involved. For example, the present invention can be adapted for vending machines, parking meters, and so on. Furthermore, it is noted that the present invention can have more than two coin processing mechanisms.

DETAILED DESCRIPTION OF THE INVENTION

FIGS. 1–6 are schematic diagrams illustrating various views of ACM 100, which is a preferred embodiment of the present invention.

Figure 1:
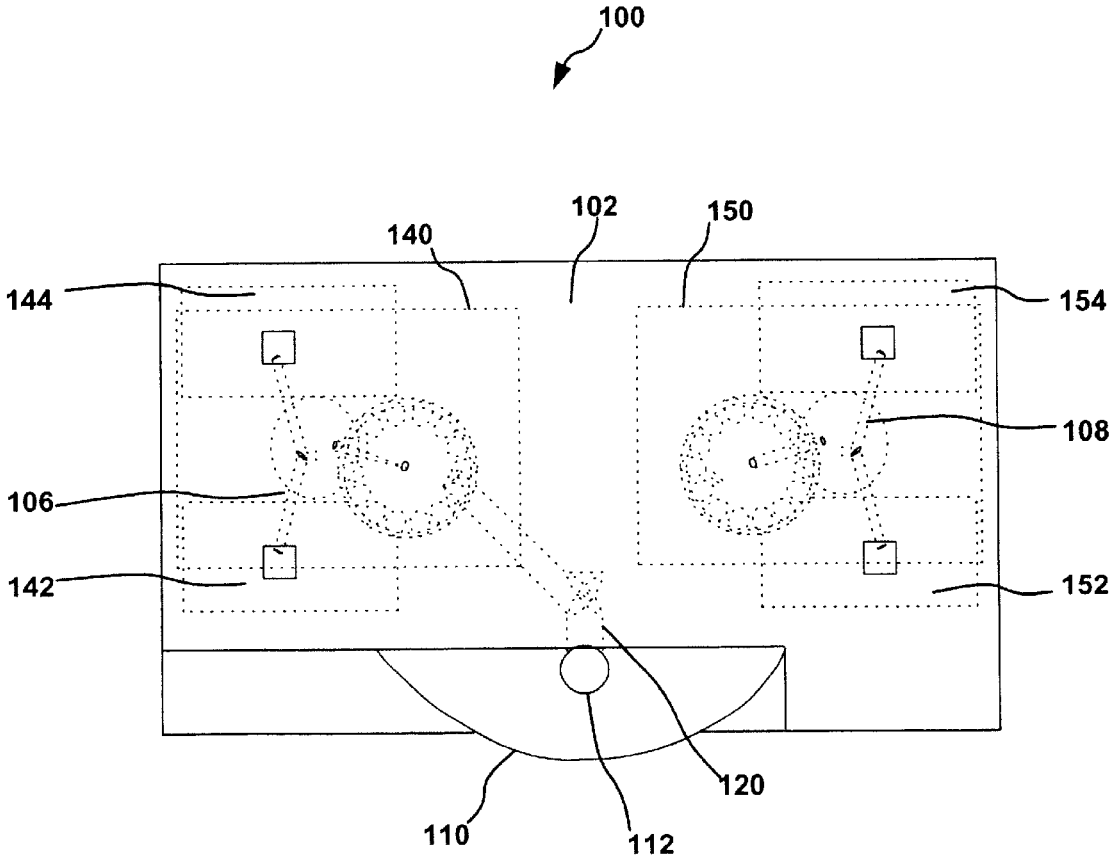
FIG. 1 is a schematic diagram illustrating a plan view of one embodiment of the ACM of the present invention that is equipped with two coin processing mechanisms.

FIG. 1 represents the plan view of ACM 100 with two coin processing mechanisms 140 and 150. In this embodiment, ACM 100 has a generally block shape. As shown, ACM 100 includes coin collection device 110 and its associated opening 112, left coin processing mechanism 140 and its associated left front vault 142, left rear vault 144, left secondary coin vault diverter 106, and right coin processing mechanism 150 and its associated right front vault 152, right rear vault 154, and right secondary coin vault diverter 108. Primary coin diverter 120, left coin processing mechanism 140, left front vault 142, left rear vault 144, right coin processing mechanism 150, right front vault 152, right rear vault 154, left secondary coin vault diverter 106, and right secondary coin vault diverter 108, which are represented in dotted lines are located within housing 102. These internal components of ACM 100 are also shown in FIG. 3.

Figure 2:
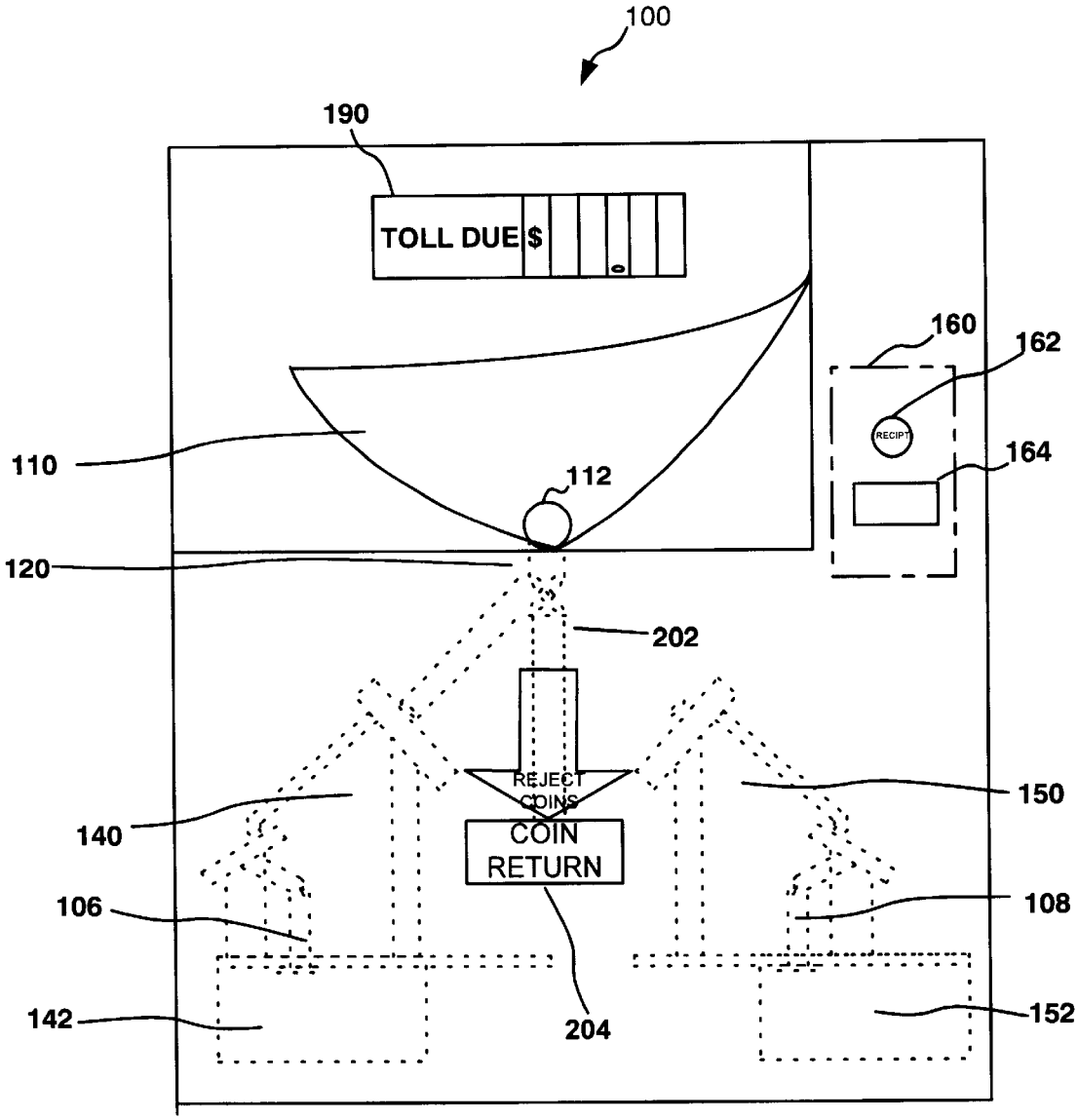
FIG. 2 is schematic diagram illustrating a front view of the ACM shown in FIG. 1, depicting a coin diverter located above a left coin processing mechanism that is active, and a front vault below each of the coin processing mechanisms.

FIG. 2 illustrates a front view of ACM 100, depicting primary coin diverter 120 above left coin processing mechanism 140 that is active. As shown, coin collection device 110 is located above primary coin diverter 120 and coin processing mechanisms 140 and 150. Coin collection device 110 is preferably a coin collection basket or a coin hopper. Coin collection device 110 receives coins from motorists. The coins are then channeled via primary coin diverter 120 to an active coin processing mechanism. Right coin processing mechanism 150, which is inactive as shown in FIG. 2, can be serviced while left coin processing mechanism 140, the active one, is processing coins received from motorists via coin collection device 110 and primary coin diverter 120. Under left coin processing mechanism 140 are left secondary coin vault diverter 106 and two vaults. Left front vault 142 is visible in FIGS. 1, 2, 3, 4 and 5. Left rear vault 144 is visible in FIGS. 1, 3 and 5. Left secondary coin vault diverter 106 channels coins from left coin processing mechanism 140 to one of left front vault 142 and left rear vault 144. Similarly, under right coin processing mechanism 150 are right secondary coin vault diverter 108 and two vaults. Right front vault 152 is visible in FIGS. 1, 2, 3, 4, and 6. Right rear vault 154 is visible in FIGS. 1, 3 and 6. Right secondary coin vault diverter 108 channels coins from right coin processing mechanism 150 to one of right front vault 152 and right rear vault 154. It is noted that an ACM in accordance with the present invention can have more than two coin processing mechanisms, and each coin processing mechanism of the present invention can have one or more vaults having capacity for storing coins.

As shown in FIG. 2, among other components, ACM 100 includes display 190, receipt printer 160, receipt printer button 162, receipt delivery chute 164, coin rejection chute 202, and coin return tray 204. Display 190 can be used to inform a motorist the amount of fare that is due. Display 190 can also be used to display the greetings or the status of the system. The motorist can press receipt printer button 162 to obtain a receipt. Receipt printer 160 can produce a receipt for the motorist indicating the fare paid and other information related to the transaction, including the date and time on which the receipt is printed.

Figure 3:
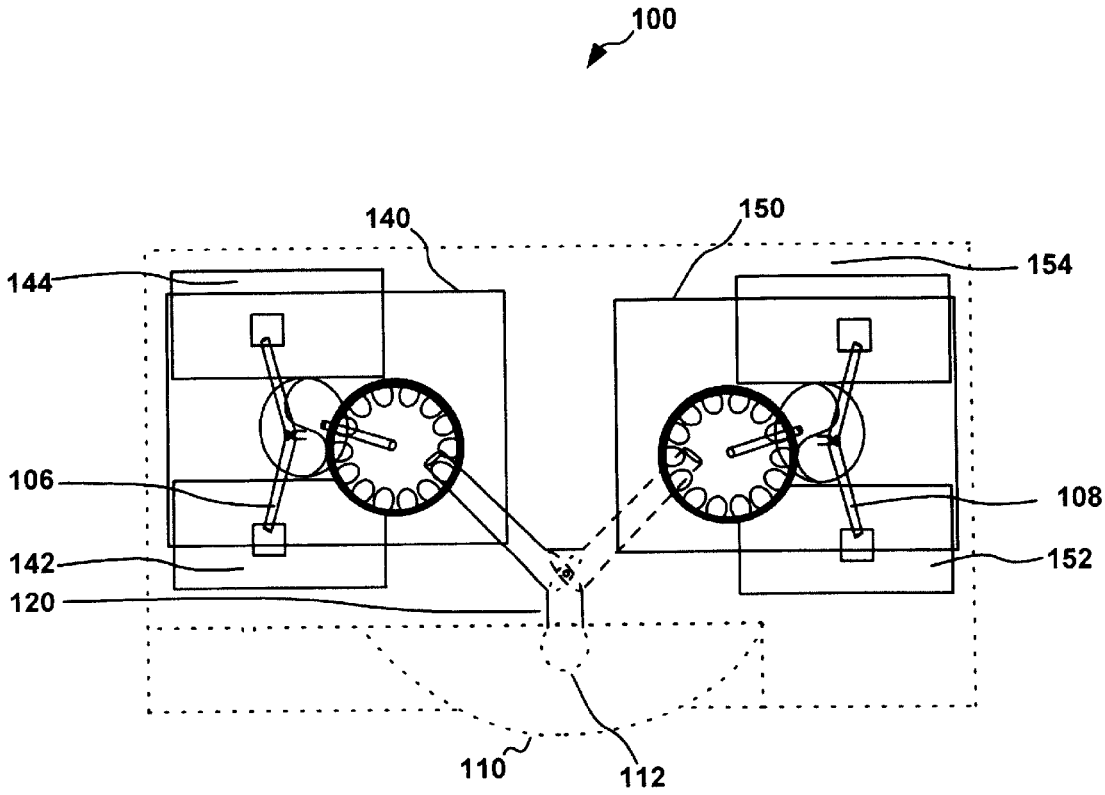
FIG. 3 is schematic diagram illustrating a cut-away, plan view of the ACM shown in FIG. 1.

FIG. 3 illustrates a cut-away, plan view of ACM 100.

Figure 4:
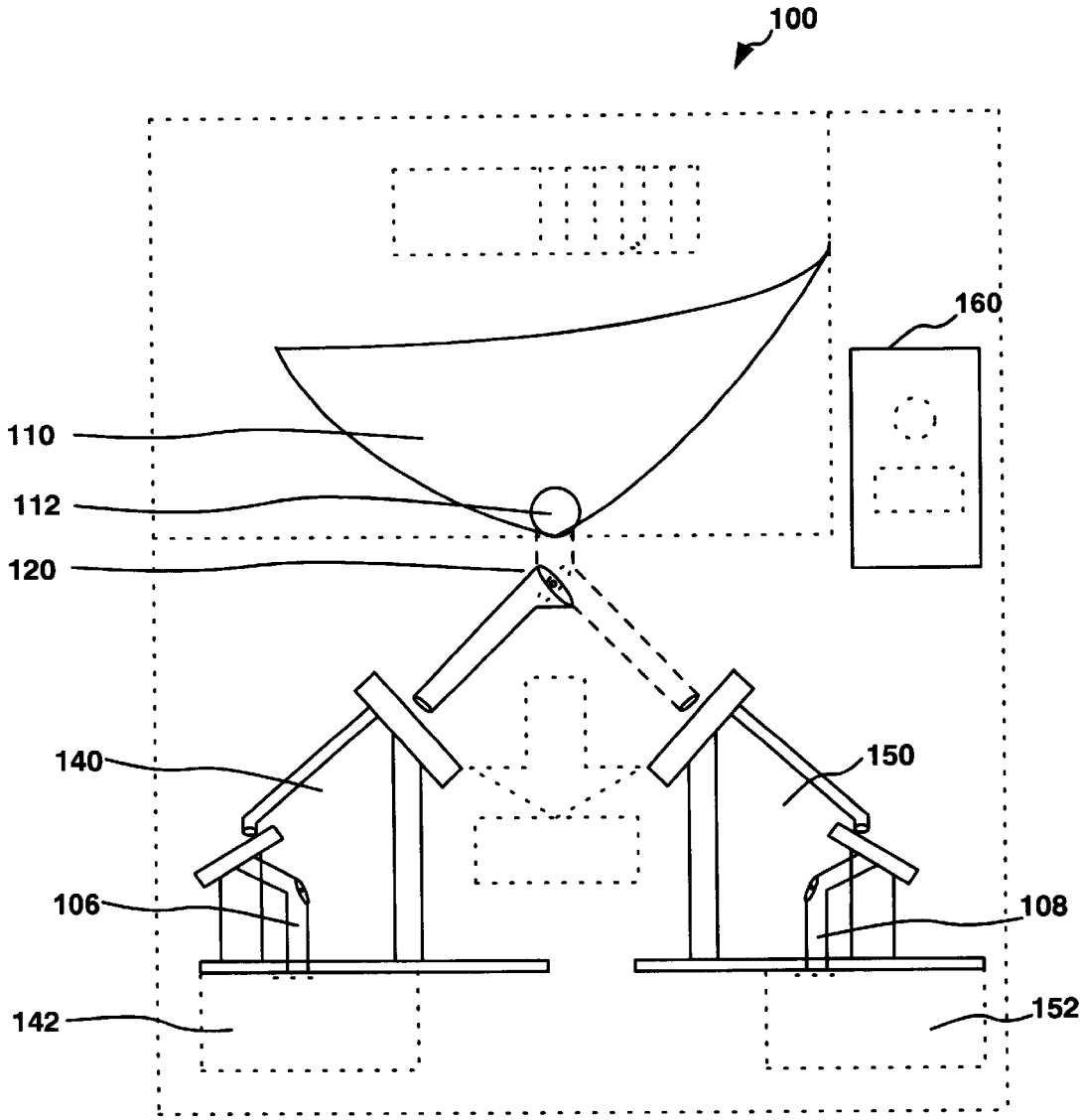
FIG. 4 is schematic diagram illustrating a cut-away, front view of the ACM shown in FIG. 1, depicting a coin diverter above a left coin processing mechanism that is active, and a front vault below each of the coin processing mechanisms.

FIG. 4 illustrates a cut-away, front view of ACM 100.

Figure 5:
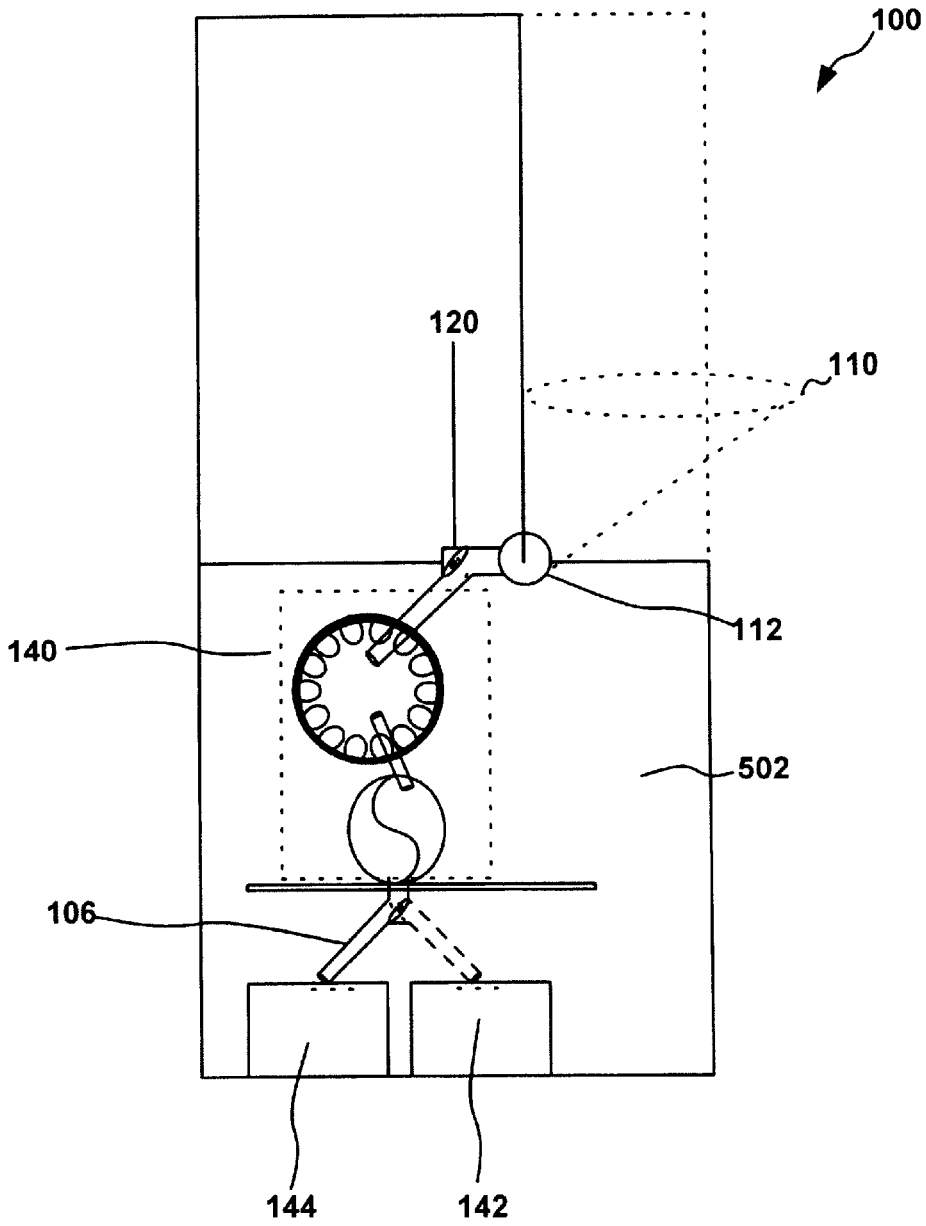
FIG. 5 is schematic diagram illustrating a cut-away, left-side view of the ACM shown in FIG. 1, depicting two left vaults (front and rear) located within a lower compartment.

FIG. 5 illustrates a cut-away, left-side view of ACM 100, depicting left coin processing mechanism 140, left secondary coin vault diverter 106, left front vault 142 and left rear vault 144 to be located within left compartment 502 of ACM 100. As shown in this embodiment, left secondary coin vault diverter 106 is positioned so that left rear vault 144 is selected to store the coins received via coin collection device 110 and left coin processing mechanism 140. When left rear vault 144 loses its capacity to store coins, the position of left secondary coin vault diverter 106 can be changed so that left front vault 142 can be used to store the coins. The position of left secondary coin vault diverter 106 can be changed manually or electronically.

Figure 6:
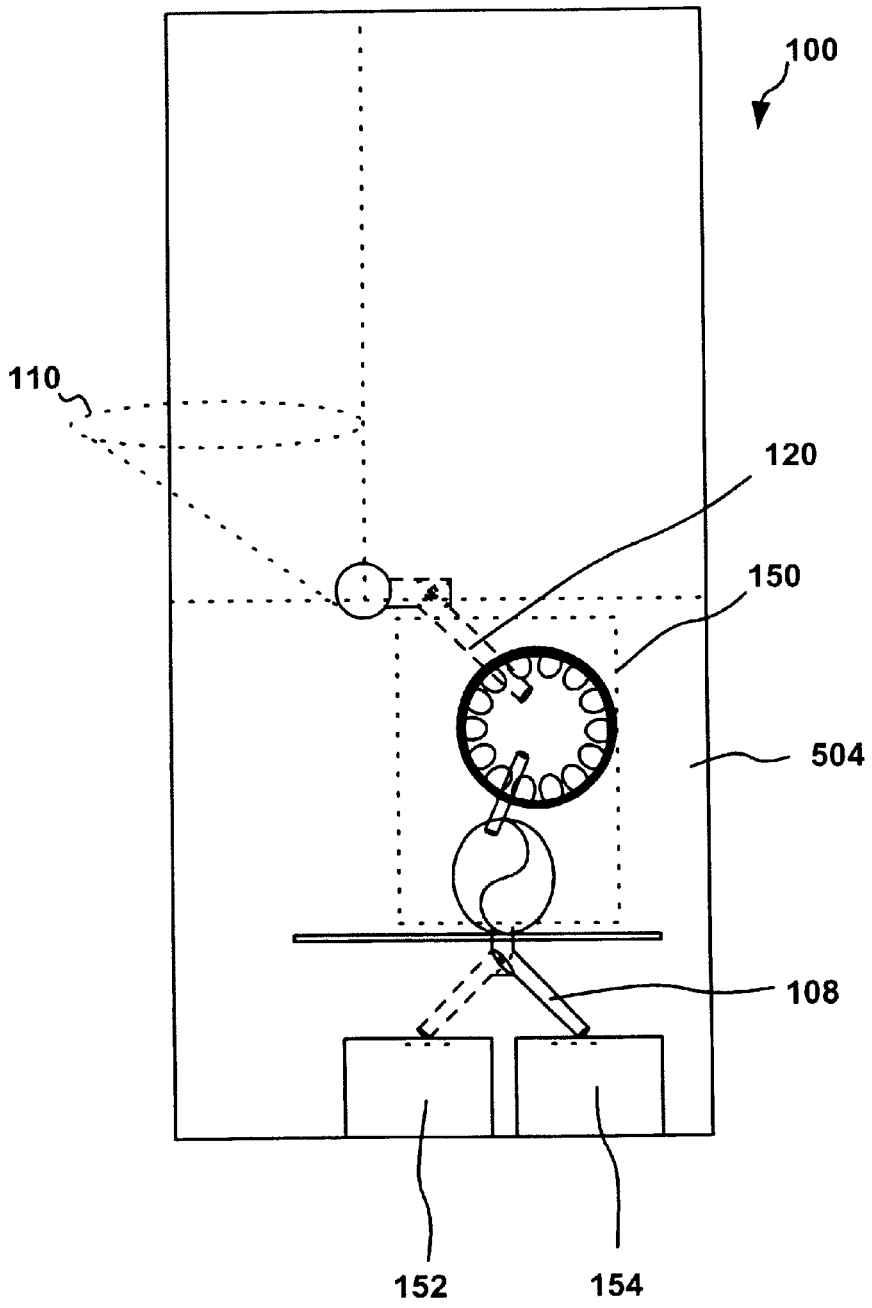
FIG. 6 is schematic diagram illustrating a cut-away, right-side view of the ACM shown in FIG. 1, depicting two right vaults (front and rear) located within the lower compartment.

FIG. 6 illustrates a cut-away, right side view of ACM 100, depicting right processing mechanism 150, right secondary coin vault diverter 108, right front vault 152, and right rear vault 154 to be located within lower right compartment 504.

Figure 7:
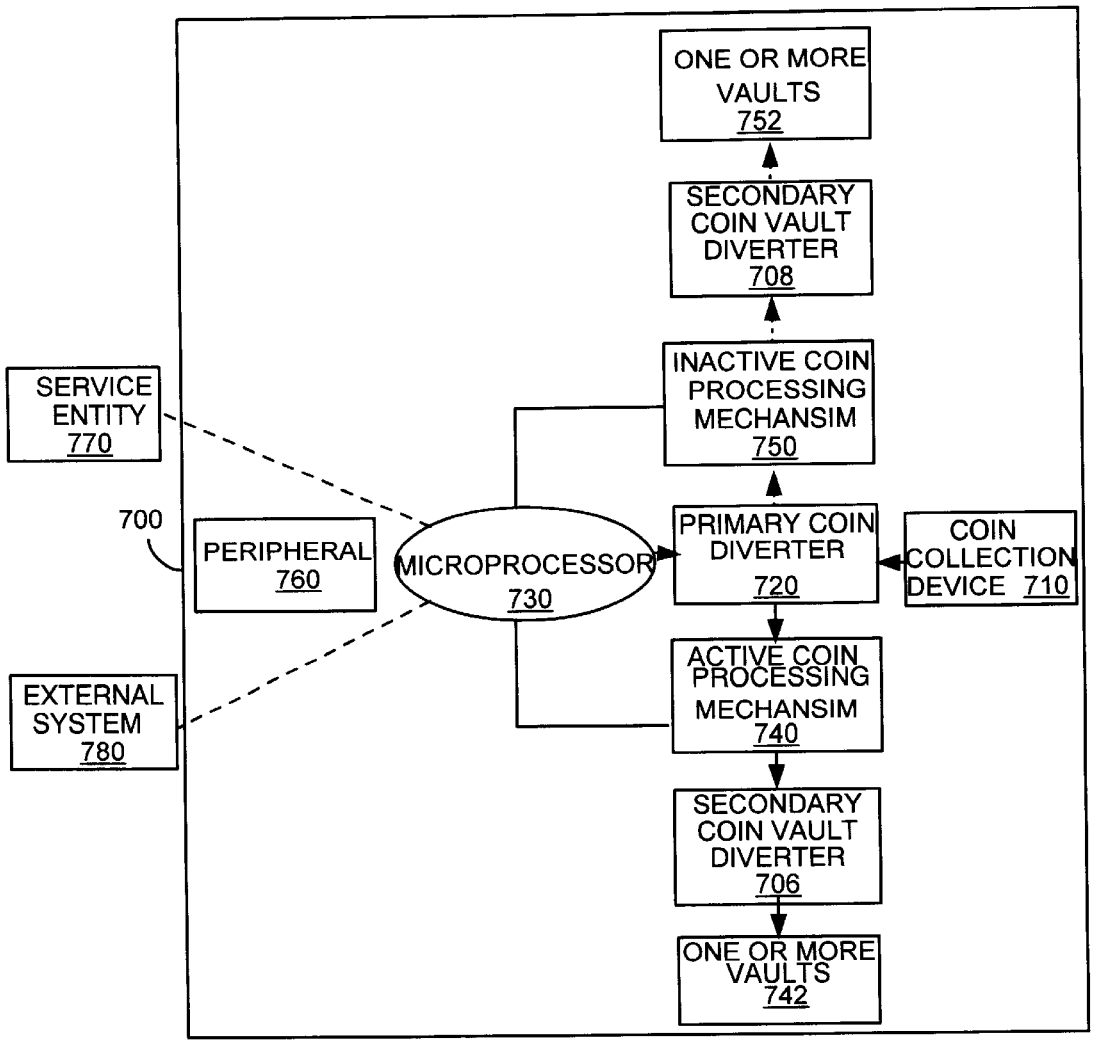
FIG. 7 is a schematic diagram of the architecture of an embodiment of the present invention.

FIG. 7 is a schematic diagram of the architecture of an embodiment of the present invention. ACM 700 in this embodiment has coin collection device 710, primary coin diverter 720, microprocessor 730, active coin processing mechanism 740, inactive coin processing mechanism 750, and peripheral 760. In addition, coin processing mechanism 740 is associated with secondary coin vault diverter 706 and at least one vault 742. Similarly, coin processing mechanism 750 is associated with secondary coin vault diverter 708 and at least one vault 752. It is noted that the activation status of coin processing mechanisms 740 and 750 depends on which one of them is the target of primary coin diverter 720. As shown in FIG. 7, coin processing 740 is active because primary coin diverter 720 is positioned or configured to channel or direct coins received by coin collection device 710 to it. In a situation in which primary coin diverter 720 aims at coin processing mechanism 750, coin processing mechanism 750 would be active and coin processing mechanism 740 would be inactive.

Coin collection device 710 is preferably a coin collection basket or a coin hopper. Coin collection device 710 preferably has a large receiving mouth into which coins can be deposited. Preferably, coin collection device 710 is funneled shaped. Coin collection device 710 can be made of various types of materials, including plastics and metals.

Preferably, primary coin diverter 720 is a generally L-shape coin diverter that has a receiving inlet and an exit point. The receiving inlet is located directly below coin collection device 710 to receive coins from coin collection device 710. The exit point of primary coin diverter 720 directs or channels the coins to an inlet opening of active coin processing mechanism 740. Primary coin diverter 720 can be manually switched from one coin processing mechanism to another coin processing mechanism. Preferably, primary coin diverter 720 can be electronically operated to switch from one coin processing mechanism to another coin processing mechanism.

Primary coin diverter 720 can be directed to switch the delivery of coins between or among the coin processing mechanisms by microprocessor 730, which is in communication with primary coin diverter 720 as well as coin processing mechanism 740 and 750. Preferably, microprocessor 730 is an integrated component of ACM 700. Alternatively, microprocessor 730 can be part of a computer that is physically separated from ACM 700. In that case, primary coin diverter 720 can be remotely manipulated by accessing ACM 700 controls via a computer network, e.g., a local area network (LAN), a wide area network (WAN), and the like. The position of primary coin diverter 720 can also be controlled by ACM software, which monitors the availability of coin processing mechanisms 740 and 750 and the availability of unused storage capacity of coin vaults 742 and 752.

As stated above, one of coin processing mechanisms 740 and 750 is active while the remaining mechanism is inactive. Active coin processing mechanism 740 is the mechanism at which primary coin diverter 720 is aimed. Active coin processing mechanism 740's inlet opening receives coins from primary coin diverter 720. The remaining inactive coin processing mechanism 750 can be serviced without affecting operation of active coin processing mechanism 740. Preferably, each of the coin processing mechanisms 740 and 750 is equipped with coin-sensing circuitry, slug rejection, and coin escrow. These and additional components of ACM 700 are not described herein because the use and operation of the components are well known in the art.

Vaults 742 and 752 are used to safeguard coins processed by coin processing mechanisms 740 and 750, respectively. Preferably, each of coin processing mechanisms 740 and 550 has more than one vault. Preferably, each of coin processing mechanisms 740 and 750 is equipped to deposit coins in a standby vault that has capacity to receive more coins when a first vault is full or loses its capacity to store the coins by changing a position of secondary coin vault diverters 706 and 708, respectively.

Preferably, each of secondary coin vault diverters 706 and 708 is generally L-shape coin diverter that has a receiving inlet and an exit point. The receiving inlet of secondary coin vault diverter 706 is located below active coin processing mechanism 740 to receive coins from active coin processing mechanism 740. The exit point of secondary coin vault diverter 706 directs or channels the coins to one of vaults 742. Similarly, the receiving inlet of secondary coin vault diverter 708 is located below inactive coin processing mechanism 750 to receive coins from coin processing mechanism 750 when it becomes active. The exit point of secondary coin vault diverter 708 directs or channels the coins to one of vaults 752. Secondary coin vault diverters 706 and 708 can be manually switched from one vault to another vault. Preferably, secondary coin vault diverters 706 and 708 can be electronically operated to switch from one vault to another vault. Preferably, secondary coin vault diverters 706 and 708 can be directed to switch the delivery of coins between or among the vaults by microprocessor 730.

Peripheral 760 is in communication with microprocessor 730. Peripheral 760 can be, for example, a printer. The printer can generate receipts based on the amount of coin processed by active coin processing mechanism 740. Preferably, the printer is adapted to include the date and time of the transaction on each receipt that it prints.

Preferably, microprocessor 730 is adapted to communicate with service entity 770. Service entity 770 can be, for example, the maintenance department of a toll road authority that operates ACM 700. Microprocessor 730 is preferably adapted to notify service entity 770 when, for example, one of the coin processing mechanisms requires service.

Preferably, microprocessor 730 is adapted to communicate with external system 780. External system 780 can be, for example, a toll gate and/or a traffic signal system. Microprocessor 730 is preferably adapted to cause the toll gate to go up or to indicate a green light on external system 780 when an adequate number of coins have been received and processed by ACM 700.

Figure 8:
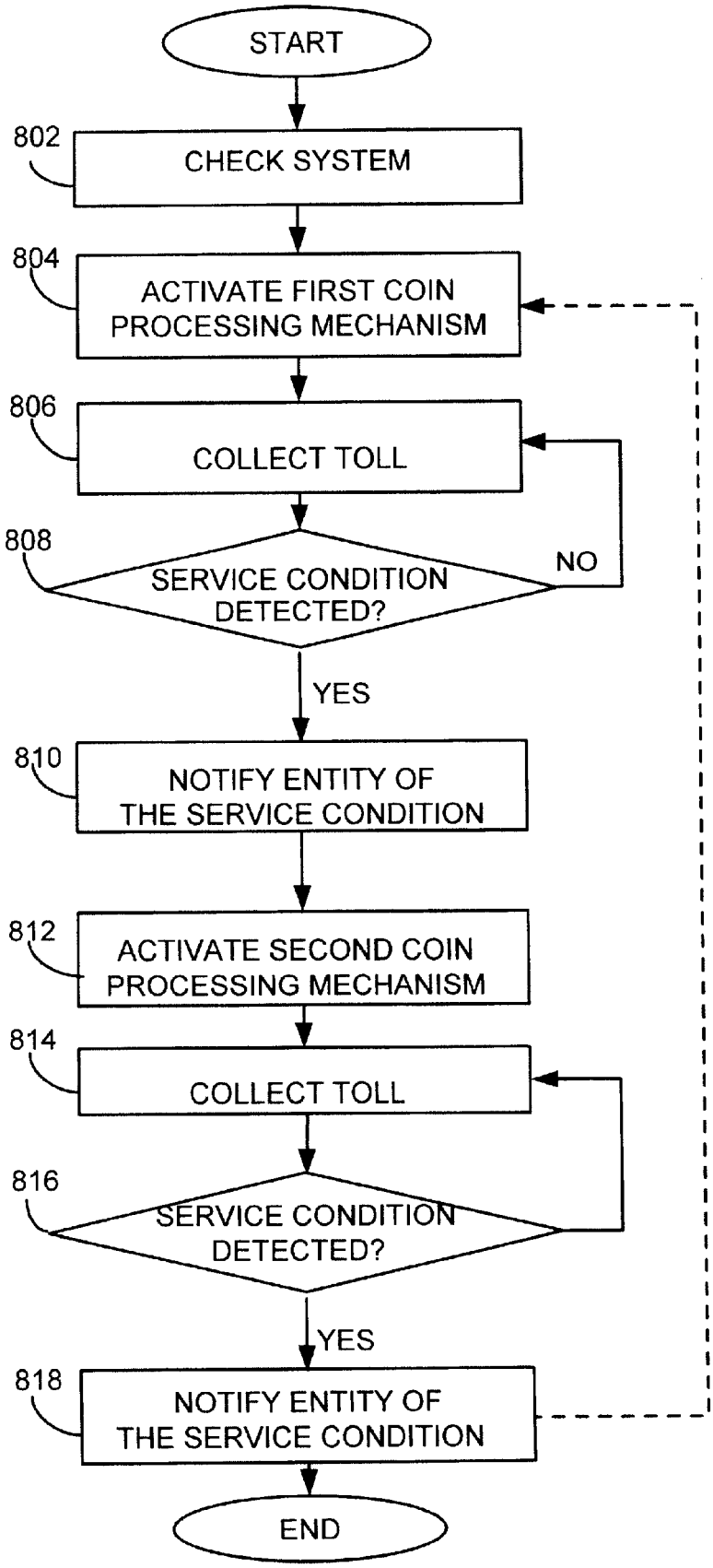
FIG. 8 is a flowchart showing general steps involved in an operation of an embodiment of the ACM of the present invention in a toll collection application.

FIG. 8 is a flowchart showing exemplary steps involved in an operation of an embodiment of an ACM system of the present invention.

In step 802, the system runs a self test when it is powered up. The self test includes checking essential software and hardware components of the system.

In step 804, the system activates a first coin processing mechanism. Preferably, the first coin processing mechanism has one or more vaults having capacity for storing coins. Activation of the first coin processing mechanism includes switching a coin diverter to the inlet opening of the first coin processing mechanism.

In step 806, the system collects tolls. Collection of tolls in this step includes a number of substeps, including, for example, receiving coins from motorists through a coin collection basket; channeling the coins from the coin collection basket to a coin diverter; directing the coins by the coin diverter to the first coin processing mechanism; processing the coins by the first coin processing mechanism; and depositing the coins in a vault associated with the first coin processing mechanism.

In step 808, the system monitors whether a predefined service condition associated with the first coin processing system occurs. The predefined service condition can occur, for example, when the vault associated with the first coin processing mechanism is full, when the inlet opening of the first coin processing mechanism becomes jammed, or the first coin processing mechanism otherwise fails to process coins. As long as none of the predefined service conditions is detected, the process repeats step 806. Otherwise, the process goes to step 810.

In step 810, the system notifies an entity that a service condition has been detected. The notification can include a message that informs the entity of the service condition. The message may be, in one situation, a statement that indicates a vault or all vaults associated with the first coin processing mechanism is full. The message may also be, in a different situation, an explanation that the first coin processing mechanism is in need of service, or other appropriate explanations. The entity can be a maintenance department, a business office, or a specific vendor contracted to service the coin processing mechanism. Notification can be made by switching on a specific light, sounding a tone, sending an e-mail, or by other appropriate means.

In step 812, the system activates a second coin processing mechanism. The activation includes switching the coin diverter away from the first coin processing mechanism to the second coin processing mechanism.

It is noted that the process involved in steps 808 and 810 does not necessarily involve malfunctioning of the first coin processing mechanism. For example, the first coin processing mechanism can be taken out of service when it had continuously operated for a predetermined amount of time. In that case, a visit to the ACM is not required, and notification in step 810 can involve a simple message that a switch or activation status of the coin processing mechanisms has taken place based on a predefined schedule. For example, the message can be a statement indicating that the second coin processing mechanism is now the active coin processing mechanism instead of the first coin processing mechanism.

In step 814, the system continues to collect coins using the second coin processing mechanism. Step 814 is similar to step 806 described above.

In step 816, the system monitors whether the second coin processing system is functioning properly or whether a predefined service condition occurs. If so, the process repeats step 814. Otherwise, the process goes to step 818. Step 816 is similar to step 808 described above.

In step 818, the system notifies the entity the same way it did in step 810, only this time the messages would be about the conditions of the second coin processing mechanism.

Steps 804 through 818 can be repeated many times. If there are only two coin processing mechanisms, the first coin processing mechanism would be reactivated in step 804 when the second coin processing mechanism is taken out of service.

Figure 9:
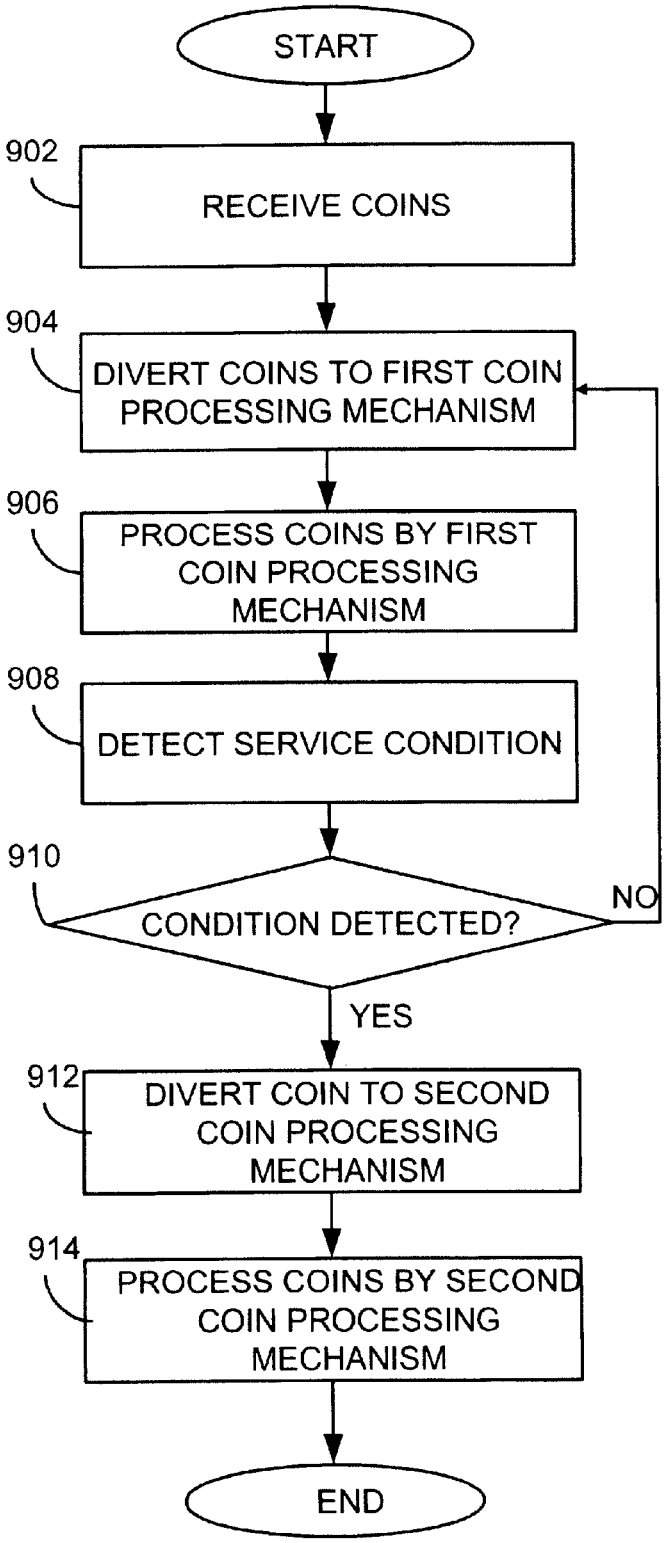
FIG. 9 is a flowchart showing general steps involved in an operation of another embodiment of the ACM of the present invention.

FIG. 9 is a flowchart showing general steps involved in an operation of another embodiment of the ACM of the present invention.

In step 902, coins are collected by a coin collection device of the ACM.

In step 904, the coins collected in step 902 are diverted by a coin diverter to a first coin processing mechanism. The first coin processing mechanism at this instance is considered the active coin processing mechanism because it receives coins through the coin diverter.

In step 906, the first coin processing mechanism or the active coin processing mechanism processes the coins.

In step 908, the performance of the active coin processing mechanism is monitored.

In step 910, if a service condition is detected, the process goes to step 912. Otherwise, the process repeats steps 904 through 910.

In step 912, the coin diverter is operated to divert coins to a second coin processing mechanism. This step deactivates the first coin processing mechanism to make the second coin processing mechanism the active coin processing mechanism.

In step 914, coins received by the ACM from this point forward are processed by the second coin processing mechanism.

The service condition in step 908 can occur in one of several ways. For example, the condition can occur when the vault associated with the first coin processing mechanism is full or loses its capacity to store coins. Another condition can happen when the inlet opening of the first coin processing mechanism becomes non-functional, e.g., jammed. Still another condition can take place when the first coin processing mechanism otherwise fails to process coins.

The foregoing disclosure of the preferred embodiments of the present invention has been presented for purposes of illustration and description. It is not intended to be exhaustive or to limit the invention to the precise forms disclosed. Many variations and modifications of the embodiments described herein will be obvious to one of ordinary skill in the art given the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. An automatic coin machine comprising:

a coin collection device adapted to receive coins;

a coin diverter including a receiving inlet for receiving the coins from the coin collection device and an exit point, wherein the coin diverter is located below the coins collection device and adapted to channel the coins to the exit point;

a plurality of coin processing mechanisms located below the coin diverter, wherein each of the plurality of coin processing mechanisms includes an inlet opening for receiving the coins from the exit point of the coin diverter; and a microprocessor in communication with one or more of the plurality of coin processing mechanisms and the coin diverter.

2. The system of claim 1, wherein the plurality of coin processing mechanisms are activated one at a time.

3. The system of claim 1, wherein a first coin processing mechanism is activated by positioning the exit point of the coin diverter to a first inlet opening of the first coin processing mechanism.

4. The system of claim 3, wherein when a service condition associated with the first coin processing mechanism is detected, the first coin processing mechanism is deactivated and a second coin processing mechanism is activated.

5. The system of claim 4, wherein the service condition associated with the first coin processing mechanism is detected when a vault associated with the first coin processing mechanism losses some of its capacity to store the coins.

6. The system of claim 4, wherein the service condition associated with the first coin processing mechanism is detected when the inlet opening of the first coin processing mechanism becomes non-functional.

7. The system of claim 4, wherein the service condition associated with the first coin processing mechanism is detected when the first coin processing mechanism fails to perform.

8. The system of claim 4, wherein the service condition associated with the first coin processing mechanism is detected when the first coin processing mechanism has operated for a predetermined period of time.

9. The system of claim 4, wherein the microprocessor is adapted to notify the service condition associated with the first coin processing mechanism.

10. The system of claim 4, wherein the first coin processing mechanism is deactivated and the second coin processing mechanism is activated by changing a position of the exit point of the coin diverter from the inlet opening of the first coin processing mechanism to an inlet opening of the second coin processing mechanism.

11. The system of claim 10, wherein the position of the exit point of the coin diverter is changed manually.

12. The system of claim 10, wherein the position of the exit point of the coin diverter is changed electronically.

13. The system of claim 10, wherein the position of the exit point of the coin diverter is changed by the microprocessor.

14. The system of claim 1, further comprising at least one vault associated with each of the plurality of coin processing mechanisms.

15. The system of claim 1, wherein the each of the plurality of coin processing mechanisms includes one or more of a coin-sensing circuitry, a slug rejection and a coin escrow.

16. The system of claim 1, wherein the coin diverter has an L shape.

17. The system of claim 1, further comprising one or more of a display and a printer in communication with the microprocessor.

18. The system of claim 17, wherein the printer is adapted to generate a receipt.

19. An automatic coin machine comprising:

a coin collection device adapted to receive coins;

a coin diverter located below the coin collection device, wherein the coin diverter is adapted to channel the coins to an exit point of the coin diverter;

a first coin processing mechanism having a first inlet opening for receiving the coins from the exit point of the coin diverter; and a second coin processing mechanism having a second inlet opening, wherein the second coin processing mechanism can be serviced without affecting operation of the first coin processing mechanism.

20. The system of claim 19, further comprising at least one vault associated with each of the first and second coin processing mechanisms.

21. The system of claim 20, further comprising a secondary coin vault diverter associated with the first coin processing mechanism for channeling the coins from the first coin processing mechanism to the at least one vault associated with the first coin processing mechanism.

22. The system of claim 20, further comprising a secondary coin vault diverter associated with the second coin processing mechanism for channeling the coins from the second coin processing mechanism to the at least one vault associated with the second coin processing mechanism.

23. The system of claim 19, wherein the coin diverter can be manually controlled to switch the exit point of the coin diverter from the first inlet opening to the second inlet opening.

24. The system of claim 19, wherein the coin diverter can be electronically controlled to switch the exit point of the coin diverter from the first inlet opening to the second inlet opening.

25. The system of claim 19, wherein each of the first coin processing mechanism and the second coin processing mechanism comprises one or more of a coin-sensing circuitry, a slug rejection, and a coin escrow.

26. The system of claim 19, further comprising a microprocessor in communication with one or more of the first coin processing mechanism, the second coin processing mechanism, and the coin diverter.

27. The system of claim 26, wherein when the first coin processing mechanism experiences a service condition, the microprocessor switches the coin diverter from the first inlet opening to the second inlet opening.

28. An automatic coin machine for use in a toll lane comprising:

a first coin processing mechanism having a first inlet opening, wherein the first coin processing mechanism is associated with one or more vaults for storing coins;

a second coin processing mechanism having a second inlet opening, wherein the second coin processing mechanism is associated with one or more vaults for storing coins;

means for monitoring service conditions associated with the first coin processing mechanism and the second coin processing mechanism;

means for alternating one of the first coin processing mechanism and the second coin processing mechanism as an active coin processing mechanism and the remaining coin processing mechanism as an inactive coin processing mechanism; and means for positioning an exit point of a coin diverter to an inlet opening associated with the active coin processing mechanism.

29. The system of claim 28, wherein one or more of the monitoring means, the alternating means, and the positioning means are associated with a microprocessor which is in communication with the first coin processing mechanism and the second coin processing mechanism.

30. The system of claim 28, wherein the coin diverter is electronically controlled by the microprocessor.

31. The system of claim 28, wherein the inactive coin processing mechanism can be serviced by a service entity without affecting operation of the active coin processing mechanism.

32. The system of claim 31, further comprising means for notifying the service entity of a change of the active coin processing mechanism to the inactive coin processing mechanism.

33. A method for using a redundant automatic coin machine having two or more coin processing mechanisms comprising the steps of:

receiving one or more coins;

diverting the one or more coins to a first coin processing mechanism;

processing the one or more coins by the first coin processing mechanism; and having a second coin processing mechanism on standby.

34. The method of claim 33, further comprising the steps of:

detecting a service condition associated with the first coin processing mechanism;

diverting the one or more coins to the second coin processing mechanism; and servicing the first coin processing mechanism without affecting operation of the second coin processing mechanism.

35. The method of claim 34, wherein the service condition occurs when a vault associated with the first coin processing mechanism loses some of its capacity to store coins.

36. The method of claim 34, wherein the service condition occurs when an inlet opening associated with the first coin processing mechanism becomes non-functional.

37. The method of claim 34, wherein the service condition occurs when the first coin processing mechanism fails to perform.

38. The method of claim 34, wherein the service condition occurs when the first coin processing mechanism has operated for a predetermined period of time.

39. The method of claim 33, further comprising the step of displaying information related to operation of the automatic coin machine.

40. The method of claim 33, further comprising the step of printing a receipt.

41. A method for using an automatic coin machine having multiple coin processing mechanisms comprising the steps of:

designating a first coin processing mechanism as an active coin processing mechanism and a second coin processing mechanism as an inactive coin processing mechanism;

positioning a coin diverter to aim an exit point of the coin diverter to a first inlet opening of the first coin processing mechanism;

detecting a service condition associated with the first coin processing mechanism;

repositioning the coin diverter to aim the exit point to a second inlet opening of a second coin processing mechanism, wherein the second coin processing mechanism replaces the first coin processing mechanism as the active coin processing mechanism, and wherein the first coin processing mechanism replaces the second coin processing mechanism as the inactive coin processing mechanism; and depositing coins collected by a coin collection device, channeled by the coin diverter, and processed by the active coin processing mechanism in a vault associated with the active coin processing mechanism.

42. The method of claim 41, further comprising the step of servicing the inactive coin processing mechanism without affecting operation of the active coin processing mechanism.

* * * * *